US010950195B1

(12) United States Patent
He et al.

(10) Patent No.: US 10,950,195 B1
(45) Date of Patent: Mar. 16, 2021

(54) APPLICATION METHOD OF DEMURA DATA HAVING UNIFORM FORMAT

(71) Applicant: TCL China Star Optoelectronics Technology Co., Ltd., Guangdong (CN)

(72) Inventors: Guanxian He, Guangdong (CN); Keyuan Liu, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 16/615,815

(22) PCT Filed: Aug. 9, 2019

(86) PCT No.: PCT/CN2019/100015
§ 371 (c)(1),
(2) Date: Nov. 21, 2019

(87) PCT Pub. No.: WO2021/017029
PCT Pub. Date: Feb. 4, 2021

(30) Foreign Application Priority Data

Jul. 29, 2019 (CN) ..... 201910691444.7

(51) Int. Cl.
*G09G 3/36* (2006.01)

(52) U.S. Cl.
CPC ..... *G09G 3/3655* (2013.01); *G09G 3/3629* (2013.01); *G09G 2310/08* (2013.01); *G09G 2320/0233* (2013.01)

(58) Field of Classification Search
CPC .... G09G 5/395; G09G 3/2096; G09G 3/3208; G09G 3/3655; G09G 3/3629; G09G 2320/0233; G09G 2310/08; G09G 3/3225
See application file for complete search history.

(56) References Cited

U.S. PATENT DOCUMENTS

| | | | | |
|---|---|---|---|---|
| 10,733,958 | B1 * | 8/2020 | Kuo | G09G 3/2096 |
| 2017/0169746 | A1 * | 6/2017 | Wu | G09G 5/395 |
| 2020/0005693 | A1 * | 1/2020 | Furihata | G09G 3/3225 |
| 2020/0126468 | A1 * | 4/2020 | Wang | G09G 3/3208 |
| 2020/0184901 | A1 * | 6/2020 | Li | G09G 3/3208 |

* cited by examiner

*Primary Examiner* — Richard J Hong

(57) ABSTRACT

An application method of demura data having a uniform format includes: in step S12, it is determined whether demura data having a first format is stored in a first memory; if yes, step S13 is performed; if no, step S16 is performed; in step S13, it is checked whether the demura data having the first format is consistent with demura data having a second format and stored in a second memory; if yes, step S14 is performed; if no, step S16 is performed; in step S14, the demura data having the first format in the first memory is read; in step S15, a demura data compensation is activated; and in step S16, demura data having the first format is generated, according to the demura data having the second format and stored in the second memory, and stored; step S15 is performed.

13 Claims, 5 Drawing Sheets

APPLICATION METHOD OF DEMURA DATA HAVING UNIFORM FORMAT

BACKGROUND

Field

The present disclosure relates to the field of display technology, and more particularly to an application method of demura data having a uniform format.

Background

Since manufacturing processes of different positions of a thin-film transistor liquid crystal display (TFT-LCD) panel are not uniform, a situation that there are differences in brightness under the same back light occurs. Areas having the differences in brightness are called as mura. To improve the image quality of the TFT-LCD panel, a timing controller chip (TCON IC) for driving the TFT-LCD panel usually has a demura function (a mura compensation function).

In the demura function, demura data of the panel stored in a flash memory is read to acquire mura situations on the different positions of the panel. Then, an appropriate data compensation for input image data is implemented according to the mura degrees of the positions of the panel, thereby decreasing the mura degrees in an image shown by the panel. The demura data of the panel stored in the flash memory is targetedly measured, calculated, and acquired during the manufacturing processes of the panel. One set of data is only suitable for one corresponding panel.

Please refer to FIG. 1. FIG. 1 illustrates a structure diagram of a conventional TFT-LCD device. A TFT-LCD panel 1 includes two types of printed circuit board assemblies including a control board (C-board) 2 and at least one X-board 3. The C-board 2 has elements such as a timing controller chip 4, a flash memory 5, and a power module attached therewith. The C-board 2 can be used in another TFT-LCD panel having the same model as the TFT-LCD panel 1. The C-board 2 can be separated from the TFT-LCD panel 1 during the shipment and then is assembled with the X-board 3. The X-board 3 is bonded with the TFT-LCD panel 1 and cannot be detachable. The X-board 3 is responsible for connecting the C-board 2 with the TFT-LCD panel 1. Accordingly, a flash memory for storing demura data is generally disposed on the X-board 3 to ensure that each set of the demura data corresponds to a correct TFT-LCD panel 1.

Please refer to FIG. 2. FIG. 2 illustrates an architecture diagram of a conventional demura system. The demura system includes the following processes.

In a first process, a system on a chip (SoC) having an embedded multimedia card (eMMC) disposed thereon controls the timing controller chip to be powered up. The timing controller chip reads firmware stored in the flash memory on the C-board after being powered up.

In a second process, demura data having a format provided by a vendor and stored in the X-board of the TFT-LCD is read after the timing controller chip is activated and operated.

In a third process, the demura data having the format provided by the vendor is stored in a register (REG) in the timing controller chip.

In a fourth process, the timing controller chip activates a demura module to implement a compensation for the demura data.

The deficiencies in the prior art are described as follows. Due to the consideration of stability of a supply chain, the manufacturer of the panel uses at least two types of timing controller chips from different vendors. The demura function is implemented by the timing controller chip. The formats which can be identified by different timing controller chips from different vendors are different. Accordingly, although the design of the TFT-LCD panel and the X-board remains unchanged, the demura data stored in the X-board has to be formulated and stored according to the corresponding timing controller chip. This increases the difficulty of management and control. However, when the C-board and the panel form a complete set during the shipment, the difficulty of management and control in the conventional scheme is acceptable.

With the increasing pressure of drop in price of the panel, a new architecture without a timing controller (TCON less) is developed. That is, the functions of the timing controller chip are undertaken by the SoC. The SoC is designed by a system manufacturer. A panel manufacturer only requires providing the TFT-LCD panel and the X-board. For the TFT-LCD panels having the same model, two situations that the panels have the timing controllers and the panels do not have the timing controllers exist. The panels which do not have the timing controllers might have various different SoC driving schemes. The panels which have the timing controllers have various different driving schemes of the timing controller chips as well. As such, the format of the demura data cannot be decided according to the timing controller chip. For the same TFT-LCD panel, it is necessary to provide demura data having the same format.

SUMMARY OF DISCLOSURE

Accordingly, an objective of the present disclosure is to provide an application method of demura data having a uniform format in which demura data of all types of panels of panel manufacturers has the uniform format.

To achieve the above-mentioned objective, the present disclosure provides an application method of demura data having a uniform format. The application method includes:

in step S11, a system chip is initialized;

in step S12, it is determined whether demura data having a first format is stored in a first memory; if yes, step S13 is performed; if no, step S16 is performed;

in step S13, it is checked whether the demura data having the first format is consistent with demura data having a second format and stored in a second memory; if the demura data having the first format is consistent with the demura data having the second format, step S14 is performed; if the demura data having the first format is not consistent with the demura data having the second format, step S16 is performed;

in step S14, the demura data having the first format in the first memory is read;

in step S15, a demura data compensation is activated; and in step S16, demura data having the first format is generated, according to the demura data having the second format and stored in the second memory, and stored; step S15 is performed.

Step S13 includes:

in step S131, a cyclic redundancy check code of the demura data having the first format and stored in the first memory is read;

in step S132, a cyclic redundancy check code of the demura data having the second format and stored in the second memory is read; and in step S133, a cyclic redundancy check is performed on the cyclic redundancy check codes read in steps S131 and S132; if the cyclic redundancy check code of the demura data having the first format is consistent with the cyclic redundancy check code of the demura data having the second format, step S14 is performed; if the cyclic redundancy check code of the demura data having the first format is not consistent with the cyclic redundancy check code of the demura data having the second format, step S16 is performed.

Step S16 includes:

in step S161, the demura data having the second format and stored in the second memory is read;

in step S162, demura information is extracted from the demura data having the second format;

in step S163, the demura information is written, in the first format, into the first memory, and the demura information is loaded into a register of the system chip; and in step S164, the cyclic redundancy check code of the demura data having the second format is written into the first memory, and step S15 is performed.

The system chip is a timing controller chip.

The first memory is a memory on a control board, and the second memory is a memory on an X-board.

In detail, the application method includes:

in step S101, the timing controller chip reads firmware in the memory of the control board;

in step S102, it is determined whether demura data having a first format is stored in the memory of the control board. If yes, step S103 is performed. If no, step S108 is performed;

in step S103, a cyclic redundancy check code of the demura data having the first format and stored in the memory is read.

in step S104, a cyclic redundancy check code of the demura data having a second format and stored in the memory of the X-board is read;

in step S105, a cyclic redundancy check is performed on the cyclic redundancy check codes read in steps S103 and S104; if the cyclic redundancy check code of the demura data having the first format is consistent with the cyclic redundancy check code of the demura data having the second format, step S106 is performed; if the cyclic redundancy check code of the demura data having the first format is not consistent with the cyclic redundancy check code of the demura data having the second format, step S108 is performed;

in step S106, the demura data having the first format in the memory of the control board is read;

in step S107, a demura data compensation is activated;

in step S108, the demura data having the second format and stored in the memory of the X-board is read;

in step S109, demura information is extracted from the demura data having the second format;

in step S110, the demura information is written, in the first format, into the memory of the control board, and the demura information is loaded into a register of the timing controller chip; and in step S111, the cyclic redundancy check code of the demura data having the second format is written into the memory of the control board, and step S107 is performed.

The memory on the control board is a flash memory.

The memory on the X-board is a flash memory.

The system chip is a system on a chip (SoC).

The first memory is a memory on the SoC, and the second memory is a memory on the X-board.

In detail, the application method includes:

in step S201, the SoC is initialized;

in step S202, it is determined whether demura data having a first format is stored in the memory of the SoC; if yes, step S203 is performed; if no, step S208 is performed;

in step S203, a cyclic redundancy check code of the demura data having the first format and stored in the memory of the SoC is read;

in step S204, a cyclic redundancy check code of the demura data having a second format and stored in the memory of the X-board is read;

in step S205, a cyclic redundancy check is performed on the cyclic redundancy check codes read in steps S203 and S204; if the cyclic redundancy check code of the demura data having the first format is consistent with the cyclic redundancy check code of the demura data having the second format, step S206 is performed; if the cyclic redundancy check code of the demura data having the first format is not consistent with the cyclic redundancy check code of the demura data having the second format, step S208 is performed;

in step S206, the demura data having the first format and stored in the memory of the SoC is read;

in step S207, a demura data compensation is activated;

in step S208, the demura data having the second format and stored in the memory of the X-board is read;

in step S209, demura information is extracted from the demura data having the second format;

in step S210, the demura information is written, in the first format, into the memory of the SoC, and the demura information is loaded into a register of the SoC; and in step S211, the cyclic redundancy check code of the demura data having the second format is written into the memory of the SoC. Step S207 is performed.

The memory on the SoC is an embedded multimedia card (eMMC).

The memory on the X-board is a flash memory.

The present disclosure further provides an application method of demura data having a uniform format. The application method includes:

in step S301, the timing controller chip reads firmware in a memory of a control board;

in step S302, demura data having a second format in a memory of an X-board is read; and in step S303, a demura data compensation is activated.

The memory on the control board is a flash memory.

The memory on the X-board is a flash memory.

In the present disclosure, the first format and the second format respectively refer to a demura data format provided by a vendor and a uniform format provided by a panel manufacturer.

In summary, the demura data having various conventional formats can be unified by the application method of the demura data having the uniform format of the present disclosure. As a result, the difficulty of management and control can be decreased significantly. Furthermore, the develop difficulty of the demura function can be decreased significantly when system manufacturer customers purchase products of panel manufacturers without timing controller chips. All types of the panels can be compatible after only one time of the process of importing the demura data having the uniform format is performed.

BRIEF DESCRIPTION OF DRAWINGS

The technical solution, as well as other beneficial advantages, of the present disclosure will become apparent from the following detailed description of embodiments of the present disclosure, with reference to the attached drawings.

DETAILED DESCRIPTION OF EMBODIMENTS

Figure 1:
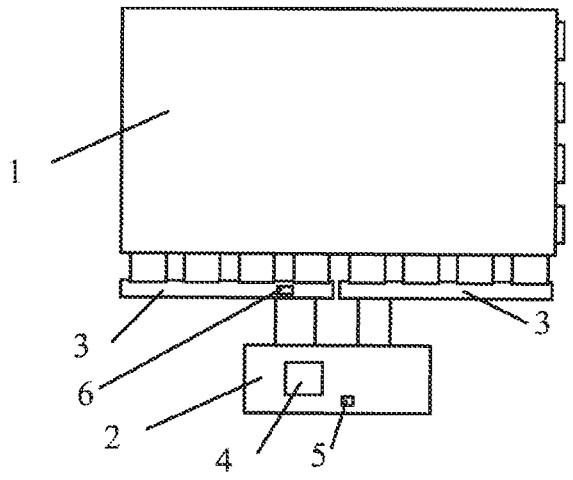
FIG. 1 (PRIOR ART)
FIG. 1 illustrates a structure diagram of a conventional TFT-LCD device.
Figure 2:
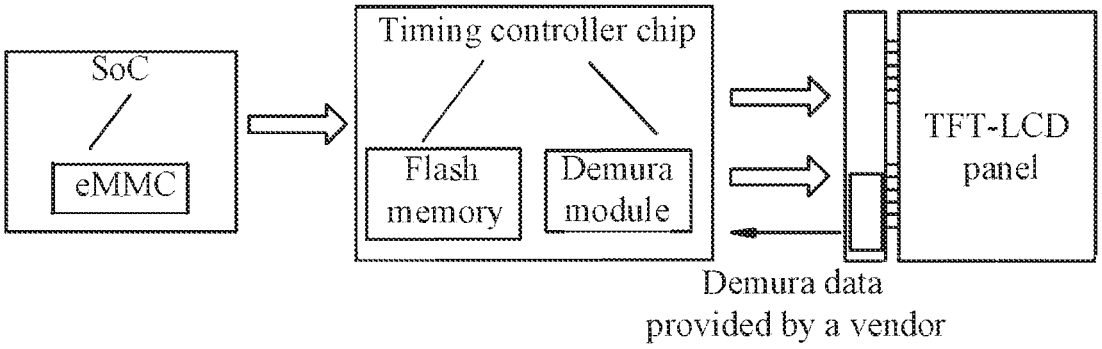
FIG. 2 (PRIOR ART)
FIG. 2 illustrates an architecture diagram of a conventional demura system.

An application method of demura data having a uniform format provided by the present disclosure mainly includes the following steps.

In step S11, a system chip is initialized.

In step S12, it is determined whether demura data having a first format is stored in a first memory. If yes, step S13 is performed. If no, step S16 is performed.

In step S13, it is checked whether the demura data having the first format is consistent with demura data having a second format and stored in a second memory. If the demura data having the first format is consistent with the demura data having the second format, step S14 is performed. If the demura data having the first format is not consistent with the demura data having the second format, step S16 is performed.

In step S14, the demura data having the first format in the first memory is read.

In step S15, a demura data compensation is activated.

In step S16, demura data having the first format is generated, according to the demura data having the second format and stored in the second memory, and stored. Step S15 is performed Step S13 may include the following steps.

In step S131, a cyclic redundancy check code of the demura data having the first format and stored in the first memory is read.

In step S132, a cyclic redundancy check code of the demura data having the second format and stored in the second memory is read.

In step S133, a cyclic redundancy check is performed on the cyclic redundancy check codes read in steps S131 and S132. If the cyclic redundancy check code of the demura data having the first format is consistent with the cyclic redundancy check code of the demura data having the second format, step S14 is performed. If the cyclic redundancy check code of the demura data having the first format is not consistent with the cyclic redundancy check code of the demura data having the second format, step S16 is performed.

Step S16 may include the following steps.

In step S161, the demura data having the second format and stored in the second memory is read.

In step S162, demura information is extracted from the demura data having the second format.

In step S163, the demura information is written, in the first format, into the first memory, and the demura information is loaded into a register of the system chip.

In step S164, the cyclic redundancy check code of the demura data having the second format is written into the first memory. Step S15 is performed.

In the present disclosure, the first format and the second format respectively refer to a demura data format provided by a vendor and a uniform format provided by a panel manufacturer. The system chip is a timing controller chip. In one aspect, the system chip may be the timing controller chip. The first memory may be a memory on a control board. The second memory is a memory on an X-board. The memory on the control board is a flash memory. The memory on the X-board is a flash memory. In another aspect, the system chip may be a system on a chip (SoC). The first memory is a memory on the SoC. The second memory is a memory on the X-board. The memory on the SoC is an embedded multimedia card (eMMC). The memory on the X-board is a flash memory.

In the following description, China Star Optoelectronics Technology Co., Ltd (CSOT) serves as an example of the panel manufacturer to explain the application method of demura data having the uniform format provided by the present disclosure. In the following embodiments, demura data having a uniform format (hereinafter referred to as "the demura data having the CSOT format") is targetedly designed in advance according to characteristics of a CSOT panel in combination with various timing controller chips and SoC s. For all types of CSOT panels, the demura data having the CSOT format is used and does not require being formulated according to the corresponding timing controller chip or SoC.

Figure 3:
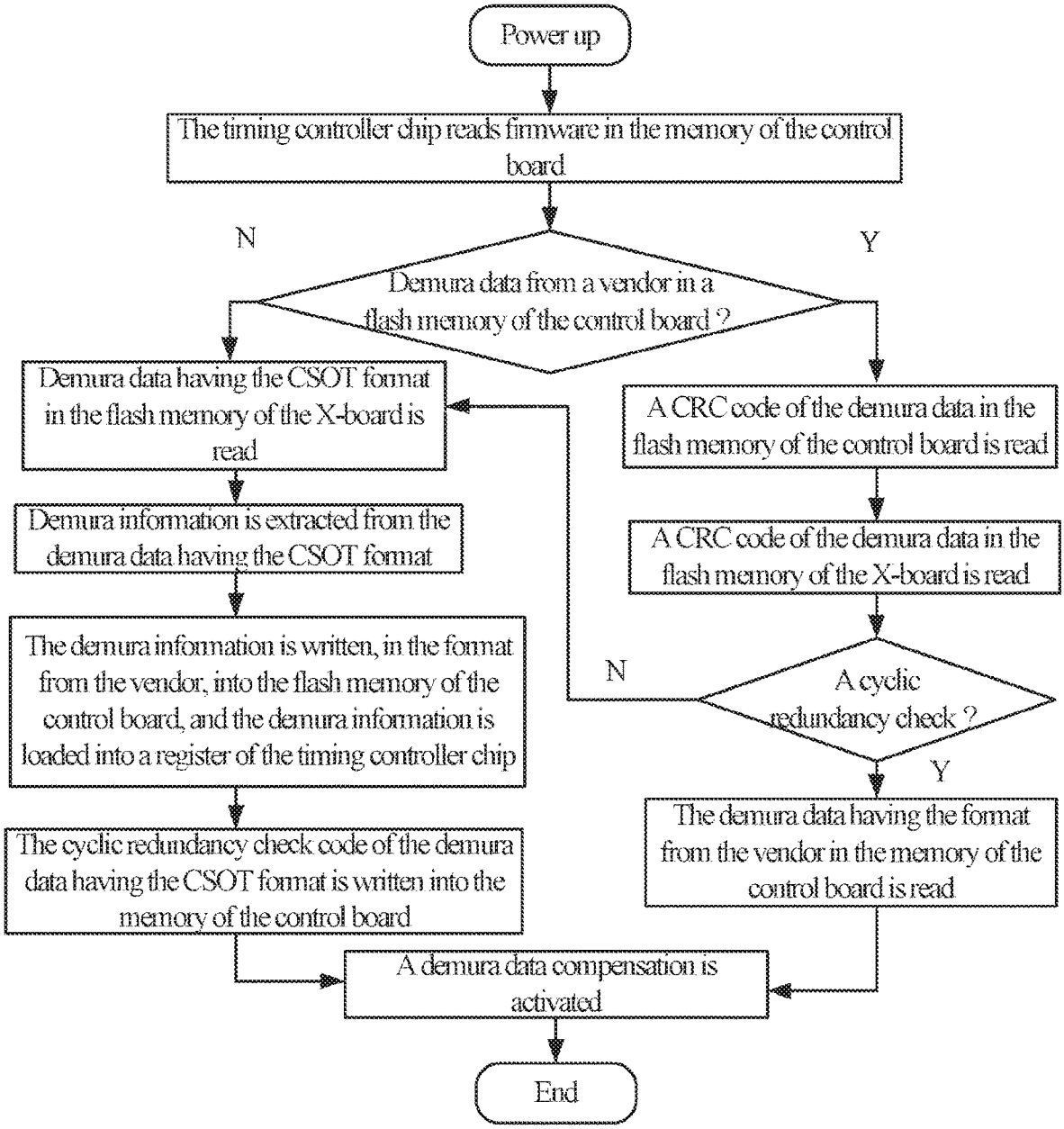
FIG. 3 illustrates a flowchart of an application method of demura data having a uniform format in accordance with a preferred embodiment of the present disclosure.
Figure 4:
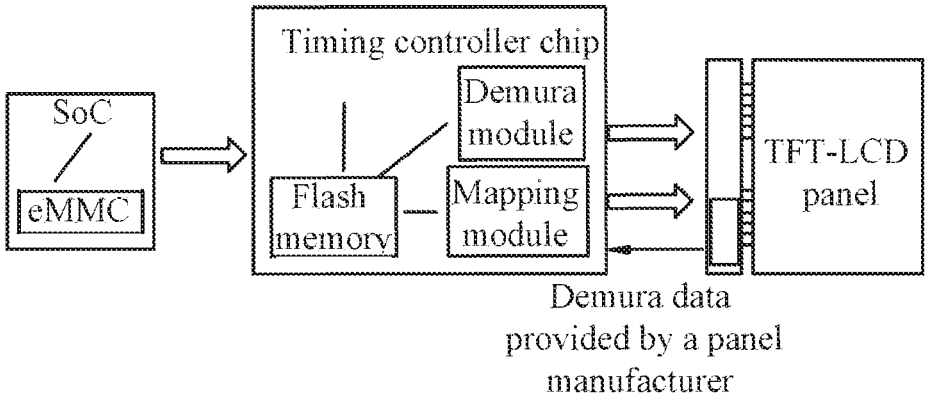
FIG. 4 illustrates an architecture diagram of a demura system using the embodiment in FIG. 3.

Please refer to FIG. 3 and FIG. 4. FIG. 3 illustrates a flowchart of an application method of demura data having a uniform format in accordance with a preferred embodiment of the present disclosure. FIG. 4 illustrates an architecture diagram of a demura system using the embodiment in FIG. 3. The present embodiment is compatible with the conventional timing controller chips and is a driving scheme aimed at the timing controller chips which are massively produced. The architecture of the demura system mainly includes: a system on a chip (SoC) having an embedded multimedia card (eMMC) disposed thereon and configured to control a timing controller chip to be powered up; a timing controller chip mainly including a flash memory for storage (the flash memory can be disposed on a control board), a demura module configured to implement a mura data compensation, and a mapping module configured to convert the format of the demura data (the mapping module can decode the demura data having the CSOT format and convert the same into demura data having a format which is provided by a vendor and can be directly read); and a flash memory on an X-board of an TFT-LCD panel configured to store the demura data having the uniform format provided by a panel manufacturer. The demura having the uniform format is the demura data having the CSOT format in the present embodiment.

It can be appreciated from FIG. 3 in combination with FIG. 4 that the timing controller chip performs the following steps after the SoC controls the timing controller chip to be powered up and activated. The memories of the control board and the X-board are flash memories in the present embodiment. The application method includes the following steps.

In step S101, the timing controller chip reads firmware in the memory of the control board.

In step S102, it is determined whether demura data having a first format is stored in the memory of the control board. If yes, step S103 is performed. If no, step S108 is performed.

In step S103, a cyclic redundancy check code of the demura data having the first format and stored in the memory is read.

In step S104, a cyclic redundancy check code of the demura data having a second format and stored in the memory of the X-board is read.

In step S105, a cyclic redundancy check is performed on the cyclic redundancy check codes read in steps S103 and S104. If the cyclic redundancy check code of the demura data having the first format is consistent with the cyclic redundancy check code of the demura data having the second format, step S106 is performed. If the cyclic redundancy check code of the demura data having the first format is not consistent with the cyclic redundancy check code of the demura data having the second format, step S108 is performed.

In step S106, the demura data having the first format in the memory of the control board is read.

In step S107, a demura data compensation is activated.

In step S108, the demura data having the second format and stored in the memory of the X-board is read.

In step S109, demura information is extracted from the demura data having the second format.

In step S110, the demura information is written, in the first format, into the memory of the control board, and the demura information is loaded into a register of the timing controller chip.

In step S111, the cyclic redundancy check code of the demura data having the second format is written into the memory of the control board. Step S107 is performed.

In step S102, time required for activating the panel for the first time is increased. A speed of activating the panel after the first time is the same as a speed in which the demura data having the format provided by the vendor is directly used.

Figure 5:
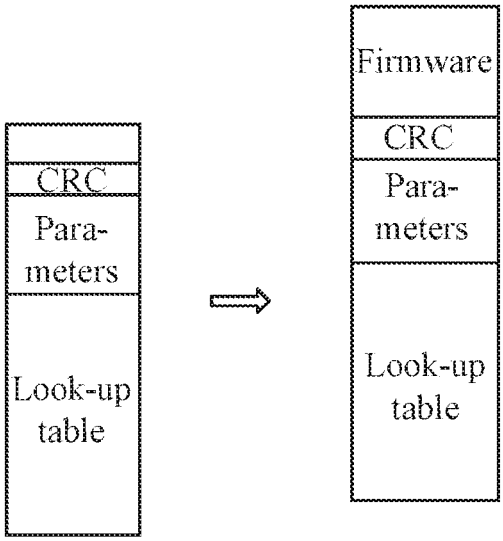
FIG. 5 illustrates that the demura data in the embodiment of FIG. 3 is converted.

Please refer to FIG. 5. FIG. 5 illustrates that the demura data in the embodiment of FIG. 3 is converted. The conventional timing controller chips cannot directly identify the demura data having the CSOT format. Accordingly, it is necessary to perform a specific process by the timing controller chip, so that the demura data having the CSOT format can be compatible. Content stored in the flash memory of the X-board and including the demura data having the CSOT format is shown in the left part in FIG. 5. The demura data having the CSOT format includes the cyclic redundancy check code, parameters, and a look-up table. Content stored in the flash memory of the control board and including the firmware, the cyclic redundancy check code, the demura data having the format provided by the vendor is shown in the right part in FIG. 5. The demura data having the format provided by the vendor includes parameters and a look-up table.

A core of the present scheme of the preferred embodiment is to use a micro control unit (MCU) embedded in the timing controller chip to decode the demura data having the CSOT format and convert the same into the demura data having the format which is provided by the vendor and can be directly read by the timing controller chip. It is determined whether the cyclic redundancy check code of the demura data having the CSOT format in the flash memory of the X-board is consistent with the cyclic redundancy check code of the demura data in the flash memory of the control board, before the timing controller chip is powered up. If the cyclic redundancy check code of the demura data having the CSOT format in the flash memory of the X-board is consistent with the cyclic redundancy check code of the demura data in the flash memory of the control board, the timing control chip reads the demura data having the format provided by the vendor form the flash memory of the control board. If the cyclic redundancy check code of the demura data having the CSOT format in the flash memory of the X-board is not consistent with the cyclic redundancy check code of the demura data in the flash memory of the control board, the converting process is performed again.

Figure 6:
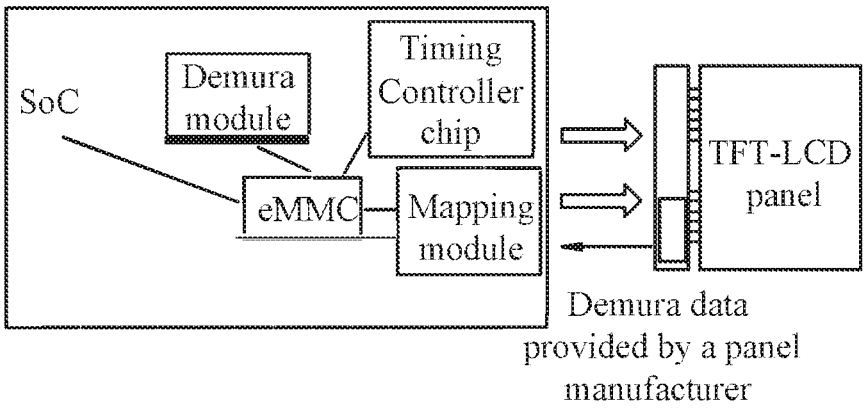
FIG. 6 illustrates an architecture diagram of a demura system using the embodiment in FIG. 7.
Figure 7:
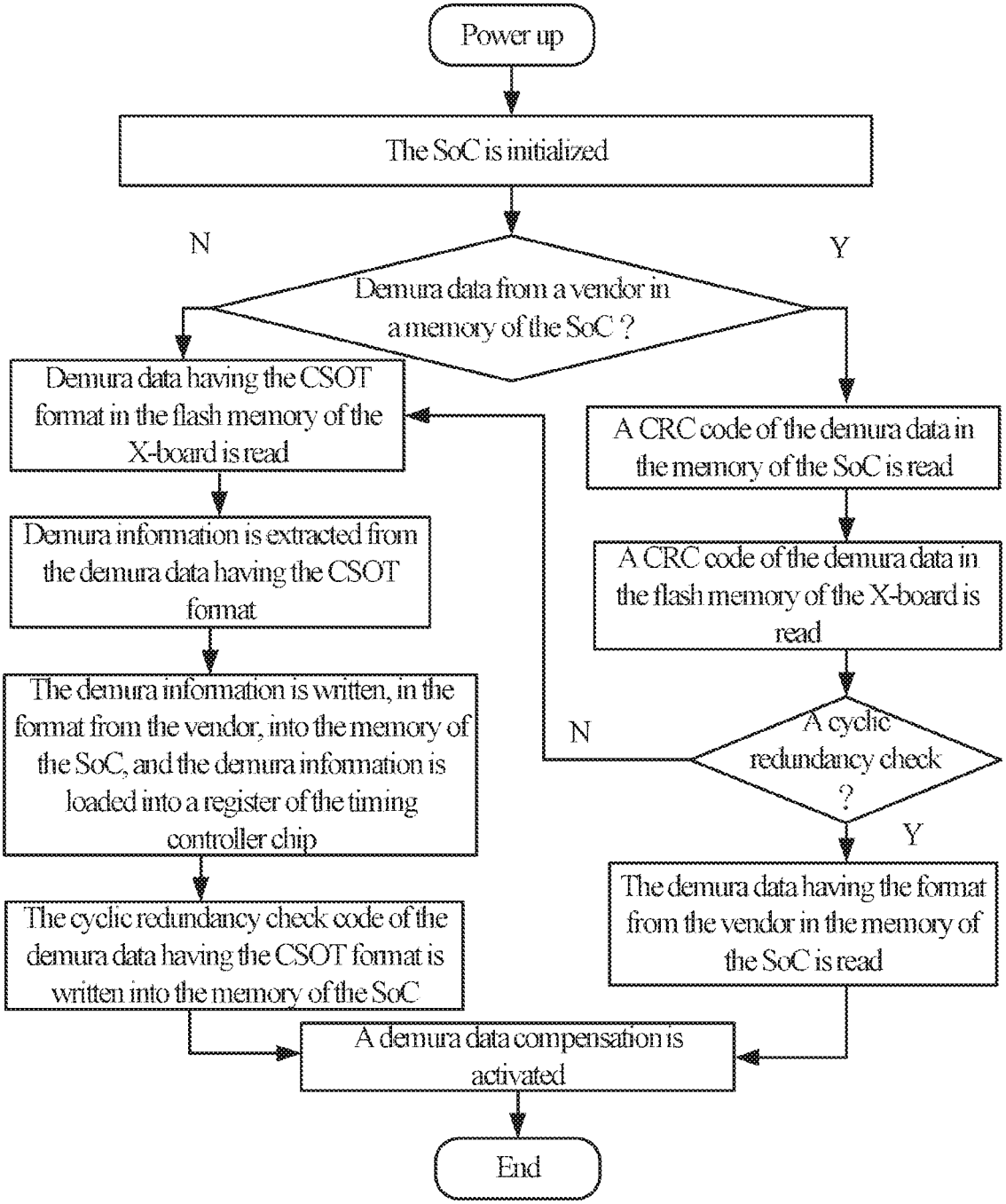
FIG. 7 illustrates a flowchart of an application method of demura data having a uniform format in accordance with another preferred embodiment of the present disclosure.

Please refer to FIG. 6 and FIG. 7. FIG. 7 illustrates a flowchart of an application method of demura data having a uniform format in accordance with another preferred embodiment of the present disclosure. FIG. 6 illustrates an architecture diagram of a demura system using the embodiment in FIG. 7. The present embodiment is a driving scheme aimed at an SoC without a timing controller chip. The architecture of the demura system mainly includes: a system on a chip (SoC) having an embedded multimedia card (eMMC) disposed thereon and configured to implement functions of a timing controller chip for controlling timing, a demura module for a mura data compensation, and a mapping module for converting the format of the demura data; and a flash memory on an X-board of an TFT-LCD panel configured to store the demura data having the uniform format provided by a panel manufacturer. The demura having the uniform format is the demura data having the CSOT format in the present embodiment.

It can be appreciated from FIG. 6 in combination with FIG. 7 that the SoC performs the following steps after the SoC is powered up and activated. In the present embodiment, the memory of the Soc is an embedded multimedia card (eMMC), and the memory of the X-board is a flash memory. The application method includes the following steps.

In step S201, the SoC is initialized.

In step S202, it is determined whether demura data having a first format is stored in the memory of the SoC. If yes, step S203 is performed. If no, step S208 is performed.

In step S203, a cyclic redundancy check code of the demura data having the first format and stored in the memory of the SoC is read.

In step S204, a cyclic redundancy check code of the demura data having a second format and stored in the memory of the X-board is read.

In step S205, a cyclic redundancy check is performed on the cyclic redundancy check codes read in steps S203 and S204. If the cyclic redundancy check code of the demura data having the first format is consistent with the cyclic redundancy check code of the demura data having the second format, step S206 is performed. If the cyclic redundancy check code of the demura data having the first format is not consistent with the cyclic redundancy check code of the demura data having the second format, step S208 is performed.

In step S206, the demura data having the first format and stored in the memory of the SoC is read.

In step S207, a demura data compensation is activated.

In step S208, the demura data having the second format and stored in the memory of the X-board is read.

In step S209, demura information is extracted from the demura data having the second format.

In step S210, the demura information is written, in the first format, into the memory of the SoC, and the demura information is loaded into a register of the SoC.

In step S211, the cyclic redundancy check code of the demura data having the second format is written into the memory of the SoC. Step S207 is performed.

In step S202, time required for activating the panel for the first time is increased. A speed of activating the panel after the first time is the same as a speed in which the demura data having the format provided by the vendor is directly used.

The SoC is designed by a system manufacturer. In all types of the CSOT panels (CSOT serves as a panel manufacturer), the demura data having the CSOT format is used. A driving scheme of the SoC of the system manufacturer is similar to that in FIG. 3. That is, a converting process is performed by a micro control unit (MCU) embedded in the chip. The conversion of the demura data can be referred to FIG. 5. However, the performance of the MCU integrated into the SoC is better than that of the MCU integrated into the timing controller chip, and thus the converting speed of the SoC is faster than that of the timing controller chip.

Figure 8:
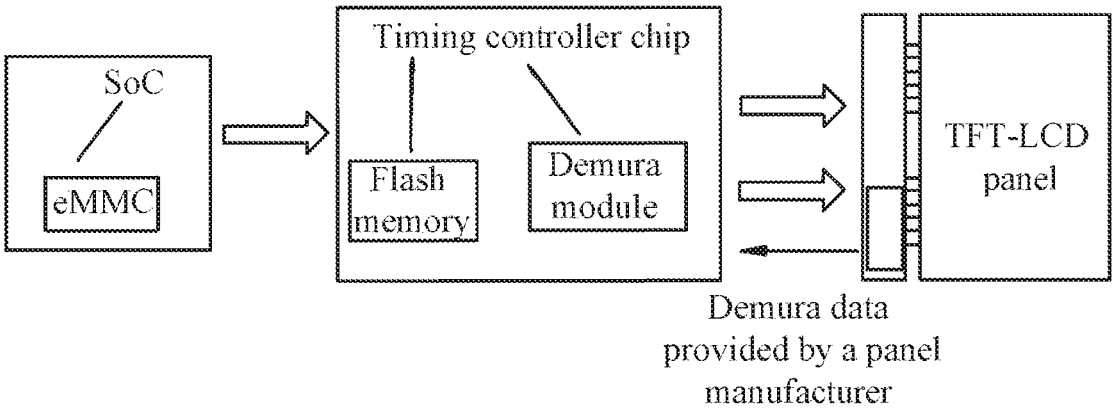
FIG. 8 illustrates an architecture diagram of a demura system using the embodiment in FIG. 9.
Figure 9:
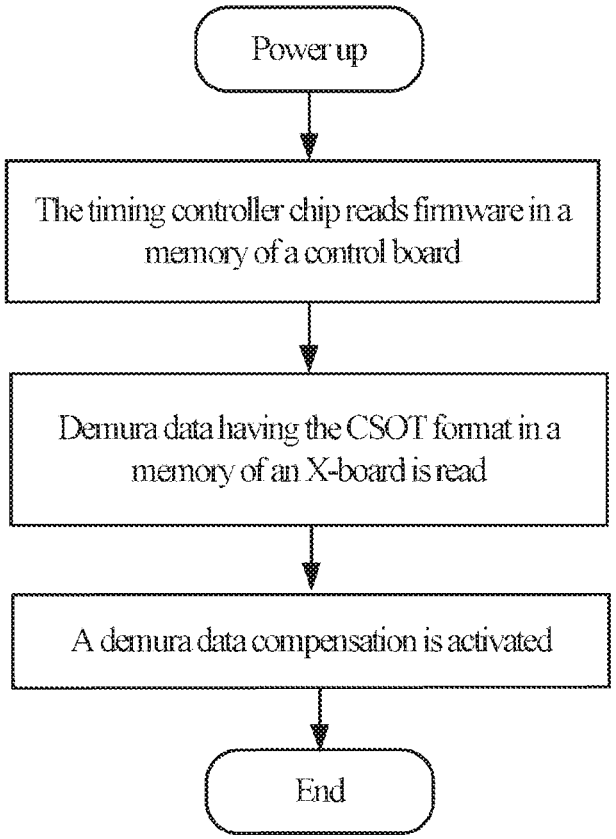
FIG. 9 illustrates a flowchart of an application method of demura data having a uniform format in accordance with yet another preferred embodiment of the present disclosure.

Please refer to FIG. 8 and FIG. 9. FIG. 9 illustrates a flowchart of an application method of demura data having a uniform format in accordance with yet another preferred embodiment of the present disclosure. FIG. 8 illustrates an architecture diagram of a demura system using the embodiment in FIG. 9. The present embodiment is a driving scheme aimed at a timing controller chip which will be newly developed in the future. When CSOT serving as the panel manufacturer and a vendor of a new timing controller chip cooperate to develop the new timing controller chip, the new timing controller chip requires reading the demura data having the CSOT format directly. As such, the new timing controller chip does not require performing the converting process. The architecture of the demura system mainly includes: a system on a chip (SoC) having an embedded multimedia card (eMMC) disposed thereon and configured to control a timing controller chip to be powered up; a timing controller chip mainly including a flash memory for storage (the flash memory can be disposed on a control board) and a demura module configured to implement a mura data compensation; and a flash memory on an X-board of an TFT-LCD configured to store the demura data having the uniform format provided by a panel manufacturer. The demura having the uniform format is the demura data having the CSOT format in the present embodiment.

It can be appreciated from FIG. 8 in combination with FIG. 9 that the timing controller chip performs the following steps after the SoC controls the timing controller chip to be powered up and activated. In the present embodiment, the memories of the control board and the X-board are flash memories. The application method includes the following steps.

In step S301, the timing controller chip reads firmware in a memory of a control board.

In step S302, demura data having a second format in a memory of a X-board is read.

In step S303, a demura data compensation is activated.

In summary, in the application method of the demura data having the uniform format of the present disclosure, the demura data having various conventional formats can be unified by the above-mentioned three demura activation processes. As a result, the difficulty of management and control can be decreased significantly. Furthermore, the develop difficulty of the demura function can be decreased significantly when system manufacturer customers purchase the CSOT panel products without timing controller chips. All types of the CSOT panels can be compatible after only one time of the process of importing the demura data having the CSOT format is performed.

In summary, many other possible modifications and variations can be made by those skilled in the art without departing from the spirit and scope of the present disclosure as hereinafter claimed, and those modifications and variations are considered encompassed in the scope of protection defined by the claims of the present disclosure.

What is claimed is:

1. An application method of demura data having a uniform format, comprising:

in step S11, a system chip is initialized;

in step S12, it is determined whether demura data having a first format is stored in a first memory; if yes, step S13 is performed; if no, step S16 is performed;

in step S13, it is checked whether the demura data having the first format is consistent with demura data having a second format and stored in a second memory; if the demura data having the first format is consistent with the demura data having the second format, step S14 is performed; if the demura data having the first format is not consistent with the demura data having the second format, step S16 is performed;

in step S14, the demura data having the first format in the first memory is read;

in step S15, a demura data compensation is activated; and in step S16, demura data having the first format is generated, according to the demura data having the second format and stored in the second memory, and stored; step S15 is performed.

2. The application method of the demura data having the uniform format of claim 1, wherein step S13 comprises:

in step S131, a cyclic redundancy check code of the demura data having the first format and stored in the first memory is read;

in step S132, a cyclic redundancy check code of the demura data having the second format and stored in the second memory is read; and in step S133, a cyclic redundancy check is performed on the cyclic redundancy check codes read in steps S131 and S132; if the cyclic redundancy check code of the demura data having the first format is consistent with the cyclic redundancy check code of the demura data having the second format, step S14 is performed; if the cyclic redundancy check code of the demura data having the first format is not consistent with the cyclic redundancy check code of the demura data having the second format, step S16 is performed.

3. The application method of the demura data having the uniform format of claim 2, wherein the system chip is a timing controller chip.

4. The application method of the demura data having the uniform format of claim 2, wherein the system chip is a system on a chip (SoC).

5. The application method of the demura data having the uniform format of claim 1, wherein step S16 comprises:

in step S161, the demura data having the second format and stored in the second memory is read;

in step S162, demura information is extracted from the demura data having the second format;

in step S163, the demura information is written, in the first format, into the first memory, and the demura information is loaded into a register of the system chip; and in step S164, the cyclic redundancy check code of the demura data having the second format is written into the first memory, and step S15 is performed.

6. The application method of the demura data having the uniform format of claim 5, wherein the system chip is a timing controller chip.

7. The application method of the demura data having the uniform format of claim 5, wherein the system chip is a system on a chip (SoC).

8. The application method of the demura data having the uniform format of claim 1, wherein the system chip is a timing controller chip.

9. The application method of the demura data having the uniform format of claim 8, wherein the first memory is a memory on a control board, and the second memory is a memory on an X-board.

10. The application method of the demura data having the uniform format of claim 9, wherein the memory on the control board is a flash memory, and the memory on the X-board is a flash memory.

11. The application method of the demura data having the uniform format of claim 1, wherein the system chip is a system on a chip (SoC).

12. The application method of the demura data having the uniform format of claim 11, wherein the first memory is a memory on the SoC, and the second memory is a memory on the X-board.

13. The application method of the demura data having the uniform format of claim 12, wherein the memory on the SoC is an embedded multimedia card (eMMC), and the memory on the X-board is a flash memory.

* * * * *